United States Patent [19]

Melzer et al.

[11] 4,370,940

[45] Feb. 1, 1983

[54] AUTOMATIC THREAD TRIMMER FOR COMPUTERIZED ZIGZAG EMBROIDERY SEWING MACHINE

[75] Inventors: Zecharia Melzer, John E. Rice, Sr., both of Louisville, Ky.

[73] Assignee: Louisville Manufacturing Co., Inc., Louisville, Ky.

[21] Appl. No.: 242,906

[22] Filed: Mar. 12, 1981

[51] Int. Cl.[3] ..... D05B 65/00

[52] U.S. Cl. ..... 112/286; 112/300

[58] Field of Search ..... 112/286, 296, 298, 300

[56] References Cited

U.S. PATENT DOCUMENTS

| | | | |
|---|---|---|---|
| 3,470,835 | 10/1965 | Saganowich et al. | 112/300 X |
| 3,601,074 | 8/1971 | Von Hagen | 112/286 |
| 4,165,700 | 8/1979 | Fletcher et al. | 112/286 |
| 4,181,088 | 1/1980 | Kessler et al. | 112/300 X |
| 4,202,286 | 5/1980 | Freire Costas | 112/286 |
| 4,230,056 | 10/1980 | Steinbach | 112/286 |

*Primary Examiner*—H. Hampton Hunter

*Attorney, Agent, or Firm*—Wenderoth, Lind & Ponack

[57] ABSTRACT

An automatic thread trimmer for use on a computerized embroidery sewing machine having a work table, a bobbin mechanism below the work table, an arm overhanging the work table with a needle driver therein movable through one cycle for each cycle of operation of the sewing machine needle, and a computerized control connected to the machine for driving the needle driver and shifting the needle according to the computer program. The thread trimmer has a thread catcher positioned below the work table and driven reciprocally across the path of a thread extending through the work table to the bobbin for catching the thread at the end of the movement in one direction and drawing the thread with the thread catching member during movement in the other direction, a cutter adjacent the path of movement of the thread catcher against which the thread catcher draws the thread for cutting the thread during movement in the other direction, a wiper positioned above the work table and reciprocally movable across the path of the thread for removing the thread after it has been cut by the cutting means, a signal producer associated with the needle drive for producing first and second signals, the first when the needle is raised clear of the path of reciprocation of the thread catcher, and the second when the needle is raised clear of the path of reciprocation of the wiper, and a control system discriminating when the signals are only in the order of the first signal and the second signal and thereupon actuating the needle drive and the wiper in sequence.

8 Claims, 10 Drawing Figures

AUTOMATIC THREAD TRIMMER FOR COMPUTERIZED ZIGZAG EMBROIDERY SEWING MACHINE

The present invention relates to an automatic thread trimmer for use on a computerized zigzag embroidery sewing machine which is operated in conjunction with a computerized control for the carrying out of the embroidery by the machine.

BACKGROUND OF THE INVENTION AND PRIOR ART

Zigzag embroidery sewing machines are currently available on the market which can embroider monograms, printing, script, performed logos and the like. Such machines are available, for example, from Meistergram Inc., of Cleveland, Ohio, under the model No. M'100-JNS and Meistermatic 600. The latter machine is a computer controlled sewing machine for embroidering monograms and the like, in which the pattern to be embroidered is entered into the memory of the computer, and the machine will carry out the embroidering in an automatic fashion as directed by an operator.

Heretofore such machines have, when shifting from one letter to another or one pattern to another in an embroidery operation, left a thread extending from the last stitch in the preceding element to the first stitch in the next element. The operator has been required to manually cut these connecting threads after the embroidering operation is completed. Naturally this is a time consuming process, particularly where there are a number of such threads in a label which has been embroidered for, for example, use in a label on the front of a billed cap.

OBJECT AND BRIEF SUMMARY OF THE INVENTION

The object of the present invention is to provide an automatic thread cutter for use with the above-described type of automatic zigzag embroidery sewing machines, which thread cutter automatically cuts the threads at the end of the last stitch in a particular element, and then pulls the cut thread from the sewn fabric.

It is a further object of the present invention to provide such an automatic thread trimmer which is controlled by an electronic control and which is electromagnetically activated in response to the electronic control.

To achieve these objects, there is provided an automatic thread trimmer which has a finger pivotally mounted beneath the needle plate of the sewing machine for pivotal movement back and forth across the path of the thread through the slot in the needle plate, the finger having a notch therein for engaging the thread at the end of the pivoting movement in one direction and drawing the thread across a knife edge when pivoting in the other direction in order to sever the thread. The finger is solenoid actuated under the control of an electronic control system coupled to the computerized control for the sewing machine itself. The device further comprises a thread wiper which is movable across the surface of the fabric being sewn in response to the operation of a further solenoid for, after the thread has been cut, removing the cut thread from the fabric. The further solenoid is likewise controlled by the electronic control system for the apparatus.

BRIEF SUMMARY OF THE DRAWINGS

The invention will now be further described in greater detail in connection with the accompanying drawings, in which.

DETAILED DESCRIPTION OF THE INVENTION

Figure 1:
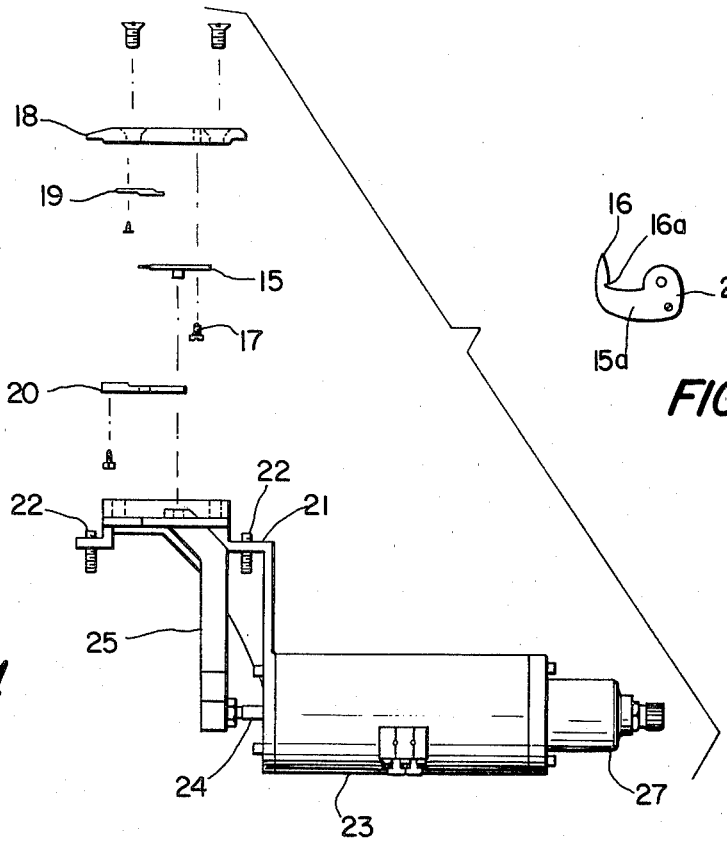
FIG. 1 is an exploded elevation view of the thread cutter and solenoid actuator therefor, according to the present invention.
Figure 1A:
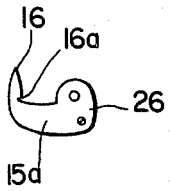
FIG. 1*a* is a plan view of the thread catcher.
Figure 2:
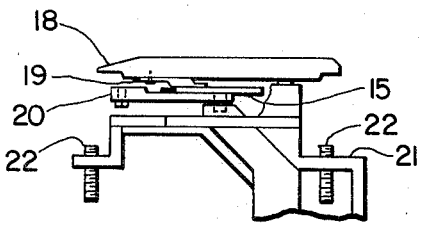
FIG. 2 is an elevation view of the device of FIG. 1 in the assembled condition.

Referring first to FIGS. 1–5, the cutter apparatus comprises a thread catching member 15, as shown in plan view in FIG. 1*a* and in elevation view in FIGS. 1 and 2, which has on the free end of the arm 15*a* thereof a pointed member 16, with a notch 16*a* being provided between the inner end of the pointed member 16 and the arm 15*a*. The thread catching member is pivoted on a pivot screw 17 to the underside of a mounting plate 18. On the mounting plate 18 between the free end of the thread catching member 15 and the mounting plate is mounted a cutter blade 19, the cutter blade 19 being secured against the bottom of the mounting plate 18 by a guard 20. This structure is supported on a mounting bracket 21 having bolt or screw elements 22 therethrough for mounting the bracket 21 on the bottom of the sewing machine. The sewing machine has a conventional work table T and overhanging arm A for carrying the needle and presser foot. The remaining parts of the sewing machine are not shown since they are not necessary to an understanding of the invention and are conventional.

Mounted on the bracket 21 is a double coil solenoid 23 having a plunger 24 which is reciprocable in a direction substantially transverse of the rotary axis of the thread catching member 15. A lever 25 is connected between the plunger 24 and the crank portion 26 of the thread catching member 15, for reciprocating the crank portion 26 for pivoting the thread catching member around the pivot screw 17 by reciprocation of the plunger 24 of the solenoid. Shown at the opposite end of the solenoid from the lever 25 is a damper structure 27 which forms no part of the present invention.

Figure 3:
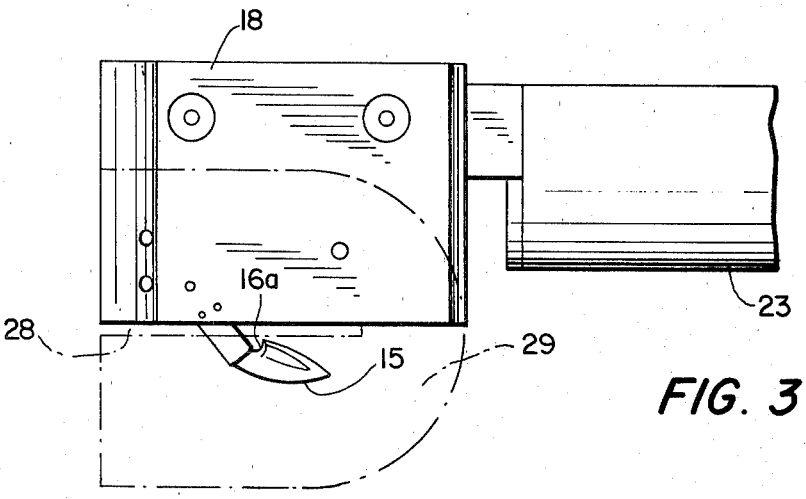
FIG. 3 is a top plan view of the assembly of the cutter structure and the solenoid thereof.
Figure 4:
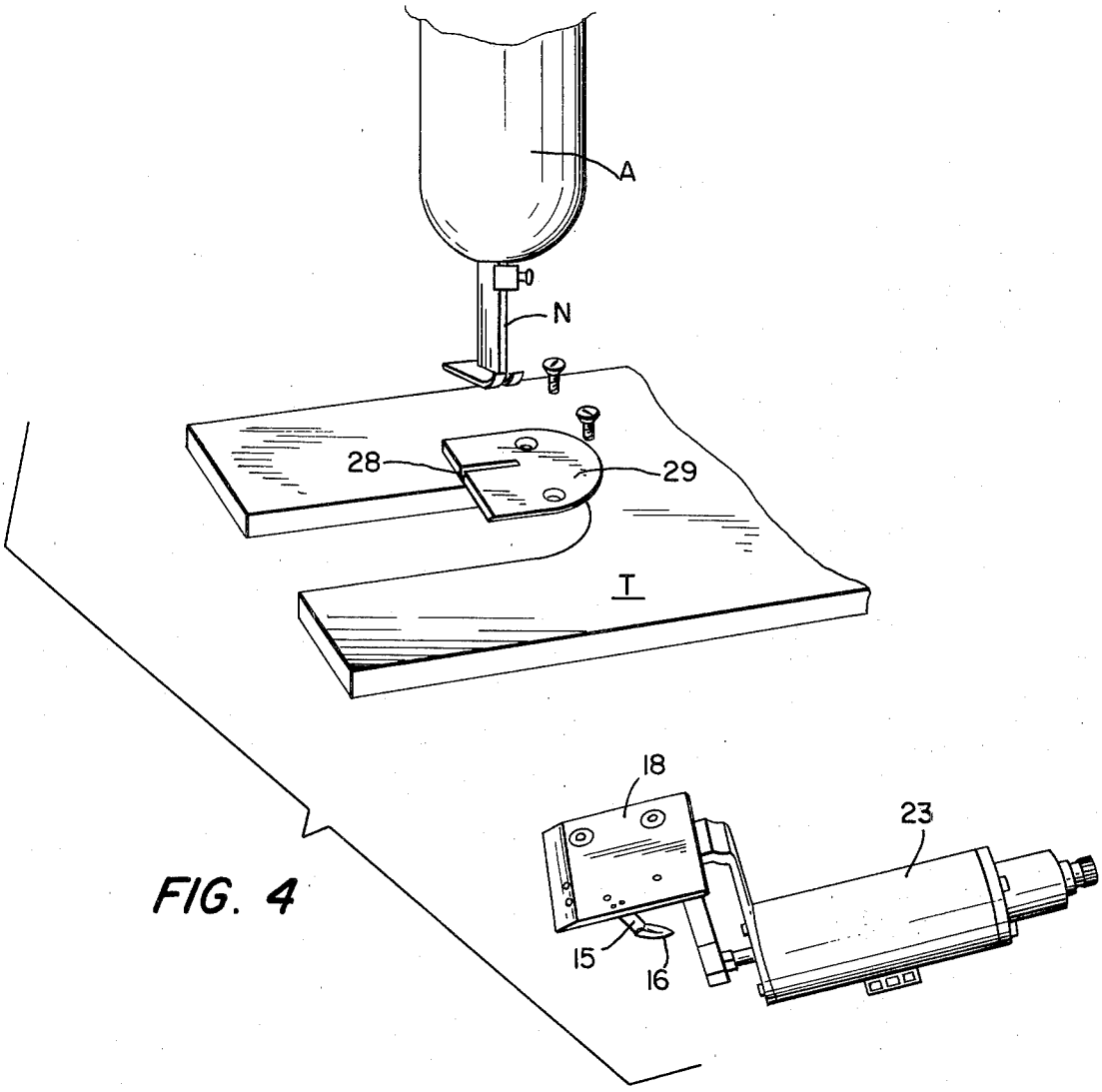
FIG. 4 is an exploded view of the cutter device and solenoid, the needle plate, the work plate of the sewing machine itself, the lower portion of the overhanging arm of the machine with the needle and the presser foot thereon.

It will be seen from the plan view of FIG. 3 and from the perspective view of FIG. 4 that the pointed member 16 on the end of the arm 15*a* and part of the arm 15*a* itself on the thread catching member projects from beneath the mounting plate 18. When the solenoid and thread catching member and associated structure are mounted by the bolts or screws 22 to the sewing machine itself, the edge of the mounting plate 18 from which the thread catching member projects is adjacent the slot 28 in the needle plate 29 so that, when the thread catching member pivots from the retracted position, in which it is drawn away from the slot 28, to the forward position, as shown in FIG. 3, it crosses the slot 28 sufficiently far so that the notch 16 can engage the thread coming from the bobbin case to the needle N (see FIG. 4).

Figure 5:
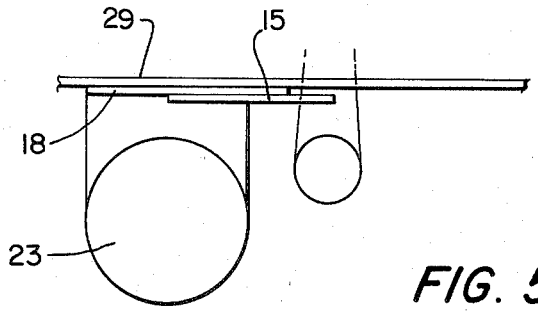
FIG. 5 is a schematic end elevation view showing the relationship of the solenoid, cutter element and the thread extending from the bobbin case through the needle plate.

In addition, the path of movement of the pointed member 16 on the arm 15*a* of the thread catching member 15 must be positioned such that it extends through the space between the lengths of thread coming from the bobbin case to the needle, as shown in FIG. 5.

In operation, under the control of the electronic control means which will be described hereinafter, when an embroidered element has been completed and the time arrives for cutting the thread, one coil of the solenoid 23 is energized to move the lever 24 outwardly away from the solenoid, which in turn pivots the thread catching member 15 to the IN position so as to move the pointed member 16 through the space between the threads as shown in FIG. 5, until the notch 16 has passed the thread. Preferably the edge of the pointed member 16 which ends at the notch 16*a* engages the thread on the side toward the solenoid, as shown in FIG. 5, so that when the notch passes the thread, the thread will spring into the notch. Thereupon the other coil of the solenoid is energized to return the solenoid plunger to its initial or OUT position, thus pivoting the thread catching member in the opposite direction to the OUT position, he pointed member 16 drawing the thread across the cutting edge of the cutter blade 19, thus severing the thread.

Figure 6:
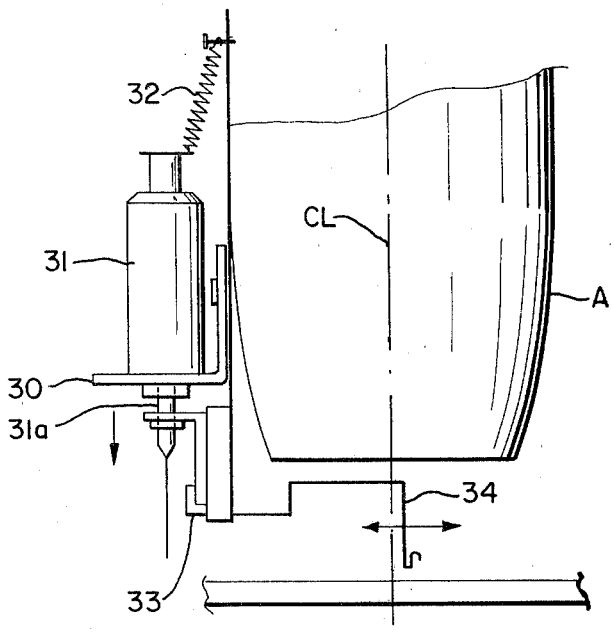
FIG. 6 is a side elevation view of the lower end of the overhanging arm of the casing of the machine with the wiper device attached thereto.

Attached to the side of the arm A of the sewing machine above the position of the needle and the presser foot is a wiper arm apparatus. This is comprised of a mounting bracket 30 secured to the arm A by bolts (not shown), and a single coil wiper solenoid 31 mounted on the bracket 30 with the plunger 31*a* thereof urged upwardly into the retracted position by the spring 32. The lower end of the plunger 31*a* is connected to a lever system 33 which has on the free end thereof a wiper 34. In the specific embodiment shown, the wiper 34 is a single piece of wire bent downwardly so that, when the wiper 34 is in the extended or forward position as shown in FIG. 6, it is only slightly above the upper surface of the work table T, and is beyond the position of the needle along the center line CL of the arm. In the retracted position, the arm 34 is swung to the left in FIG. 6 and out of the path of the needle.

After the actuation of the cutter apparatus has severed the thread, the solenoid 31 is actuated to swing the wiper arm 34 to the right in FIG. 6, so as to engage the thread which has been cut and pulled out of the cloth which is being embroidered. When the wiper arm 34 has reached the advanced position, as shown in FIG. 6, at which point the severed thread has been pulled out of the embroidered cloth, the solenoid 31 is deenergized and the spring causes the retraction of the wiper arm 34.

At this point, the sewing machine is ready to commence embroidering the next element on the cloth.

Figure 7:
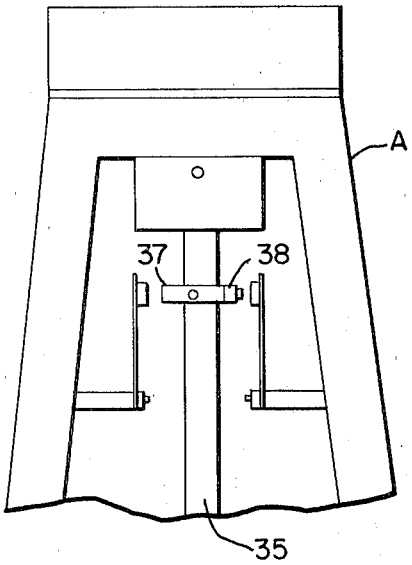
FIG. 7 is a partial plan view of the top part of the overhanging arm of the casing of the sewing machine with the cover plate removed.

The control means for controlling the operation of the respective solenoids is shown in FIG. 7.

As shown in FIG. 7, there is provided on part of the needle driving means of the sewing machine, in this embodiment the main shaft 35 of the sewing machine which extends along the horizontally projecting portion of the overhanging arm A, a magnet 36 which rotates with the shaft 35. The apparatus has means for producing signals at two positions during the cycle of operation of the needle. In this embodiment, at substantially diametrically opposite positions relative to the shaft are mounted two Hall effect devices 37 and 38, one of which is an OUT Hall effect device, and the other of which is an IN Hall effect device.

In one conventional sewing machine, namely the Meistermatic 600 machine identified hereinbefore, one such Hall effect device is provided for supplying a position signal to the computer control system. In other conventional machines, however, no such device is provided, and in such an apparatus, two such devices will be required for the control system for the present invention.

The IN Hall effect device is preferably positioned opposite the position of the magnet at the point in the operating cycle when the needle has just started rising from its lowermost position and has cleared the hook on the bobbin. The OUT Hall effect device is preferably positioned opposite the position of the magnet at the point in the operating cycle when the needle has just started descending from its uppermost position. While these are the preferred positions, other positions can be used, so long as the position of the IN device is at a point where the needle is clear of the path of movement of the thread catching device 15 and the position of the OUT device is at a point where the needle is sufficiently far above the work table so that it is not struck by the wiper 34.

Figure 8:
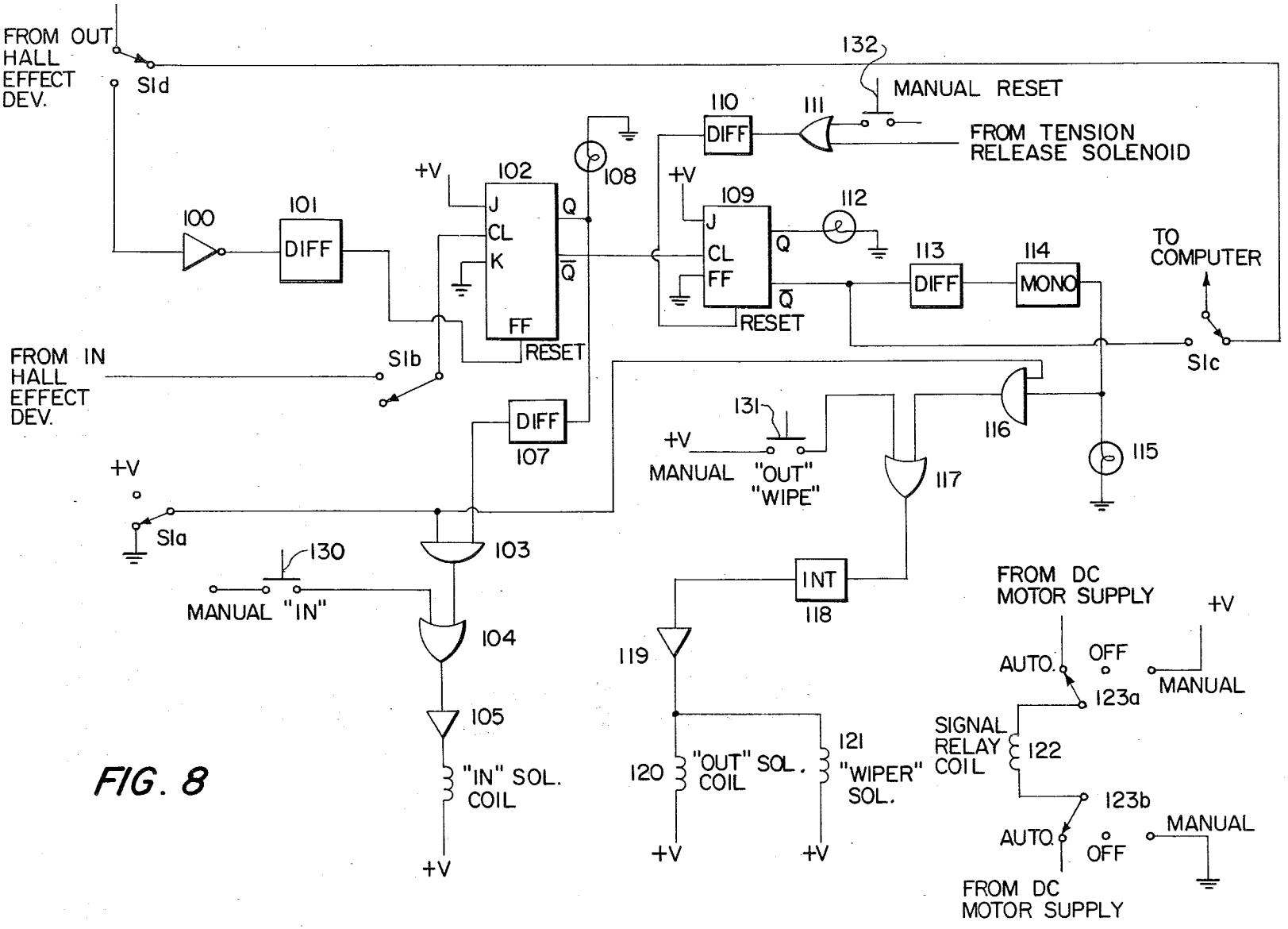
FIG. 8 is a simplified schematic diagram of the electronic circuitry of the present invention.

FIG. 8 is a simplified schematic diagram of the electronic circuitry for controlling the thread trimmer of the present invention. Switches S1*a–d* are the switch contacts of a four pole double throw relay used to connect and/or isolate the electronic circuitry for the thread trimmer of the present invention from the normal sewing machine electronics during its operation. Switch contacts S1*a–d* are shown in their deenergized position in FIG. 8.

The coil 122 of the four pole double throw relay is connected through a double pole-double throw-neutral OFF switch 123*a–b* to a current supply to a needle position DC motor which is off when the machine is sewing. In the automatic mode, the switch 123*a–b* is left in the condition shown, i.e., connecting the coil in the motor supply circuit. Thus, when the machine is sewing, the four pole double throw relay is deenergized. When the four pole double throw relay is thus deenergized, the signal from the OUT Hall effect device is routed through switch contacts S1*c*–S1*d* to the computer. AND gates 103 and 116 are inhibited by having one of each of their inputs grounded by switch contact S1*a*.

When the machine stops sewing, the computer activates the conventional needle position DC motor (not shown) thus supplying a control voltage to the relay coil 122 of the four pole double throw relay. This energizes the relay, switching switch contacts S1*a–d*. Alternatively, for manual operation, the switch 123*a–b* can be manually activated to the manual position, which will also supply a voltage to the relay coil 122. Upon being switched, switch contact S1*a* ungrounds the previously grounded inputs of AND gates 103 and 116, thereby enabling their operation. Switch contact S1*b* connects the signal output from the IN Hall effect device to the clock input of a flip-flop 102. Switch contact S1*c* connects the computer input to the output of a flip-flop 109 rather than to the output of OUT Hall effect device. Switch contact S1*d* connects the output from the OUT Hall effect device to an inverter 100 rather than to the computer.

The signal path for the electronics of the present invention is as follows:

A signal into inverter 100, after inversion, is differentiated in differentiator 101, the output of which is used to reset flip-flop 102. A clock signal from the IN Hall effect device through switch contact S1*b* is fed to the clock input of flip-flop 102 so as to set flip-flop 102.

The inverted output of flip-flop 102 is fed to the clock input of flip-flop 109, the reset input of which is fed by differentiator 110. Differentiator 110 receives its input from OR gate 111 which receives its input in turn from a manual RESET switch 132 and from a tension release solenoid signal from a conventional tension release solenoid forming part of the embroidery sewing machine.

The inverted output of flip-flop 109 is fed to the computer in place of the signal from the OUT Hall effect device through switch contacts S1*c*.

The inverted output of flip-flop 109 is also fed to a differentiator 113 the differentiated output of which triggers a monostable multivibrator 114 the output of which is fed to one input of AND gate 116.

The noninverted output of flip-flop 102 is differentiated by differentiator 107 the differentiated output of which is fed to one input of AND gate 103.

The second inputs of AND gates 103 and 116 are connected to switch contact S1*a* such that gates 103 and 116 are enabled when the four pole double throw relay is energized and disabled when the four pole double throw is deenergized.

The output of gate 103 is fed to one input of OR gate 104, the second input of which is connected to a manual IN switch 103. The output of gate 104 is amplified by power amplifier 105 and fed to one or "IN" solenoid coil 106 of solenoid 23.

The output of gate 116 is fed to one input of OR gate 117 the second input of which is connected to the manual "OUT-WIPE" switch 131. The output of gate 117 is integrated by integrator 118 and amplified in power amplifier 119. Power amplifier 119 drives both the "OUT" solenoid coil 120 of the solenoid 23 and the "WIPER" solenoid coil 121 of the wiper solenoid 31.

Indicator lamps 108, 112 and 115 respectively indicate the conditions of flip-flops 102 and 109 and monostable multivibrator 114. The operation of the electronic circuit illustrated in FIG. 8 is as follows:

While the machine is sewing, the four pole double throw relay is deenergized, thus disconnecting the electronic circuit illustrated in FIG. 8 from the computer and via switch contacts S1*a*, inhibiting gates 103 and 116 which insures the deactivation of the "IN", "OUT" and "WIPER" solenoids.

When the machine stops, the computer activates the needle position DC motor, thus supplying control voltage to the four pole double throw relay and energizing same. When the four pole double throw relay is energized, the following occurs:

1. The IN Hall effect device is connected to the clock input of flip-flop 102.

2. The OUT Hall effect device is connected to the reset input of flip-flop 102 through inverter 100 and differentiator 101.

3. AND gates 103 and 116 are enabled, making possible the subsequent energization of the IN, OUT and WIPER solenoids.

4. The computer input is connected to the inverted output of flip-flop 109.

In operation, there are two possible sequences of events when the machine stops.

A. The machine stops with the magnet between the IN and OUT positions. In such a case, the first signal to the circuit will be from the OUT Hall effect device to flip-flop 102. Since the output of the OUT Hall effect device is connected to the reset input of flip-flop 102, and since flip-flop 102 has been previously set, nothing happens and the OUT Hall effect signal is ignored. Next, the magnet passes the IN Hall effect device position, thus generating a clock signal for flip-flop 102, causing it to change state. This in turn causes a signal flow through differentiator 107, gates 103 and 104, and power amplifier 105 to energize the IN solenoid coil 106 of the solenoid 23, thus pivoting the thread catching member 15 of the IN position and energizing the thread in the notch 16*a*. Simultaneously, flip-flop 109 receives a clock signal from the inverted output of flip-flop 102 causing flip-flop 109 to change state.

The magnet continues to rotate until it faces the OUT Hall effect device again, generating a reset signal to flip-flop 102 through inverter 100 and differentiator 101, changing the state of flip-flop 102 which in turn changes the state of flip-flop 109, which in turn triggers monostable multivibrator 114 through differentiator 113. The output of monostable multivibrator 114 energizes both the OUT solenoid coil 120 and the WIPER solenoid coil 121 through the signal path consisting of gates 116 and 117, integrator 118 and power amplifier 119. This in turn again causes the thread catching member 15 to pivot back to the OUT position, drawing the thread across the blade of cutter blade 19 to cut the thread. At the same time, activation of the wiper solenoid 31 causes the wiper to remove the cut thread.

Since flip-flop 109 has changed state, it sends a low signal to the computer input indicating that the final position has been achieved. The computer then stops the DC motor, thus deenergizing the four pole double-throw relay. The tension solenoid is deactivated at this point in the generating cycle of the sewing machine, and the deactivating signal is also used for resetting the flip-flop 109 through the path consisting of gate 111 and differentiator 110.

B. The machine stops with the magnet between the OUT and IN positions. In that case the first signal generated is the signal from the IN Hall effect device and the operation corresponds to the sequence of events as described above with regard to the generation of the signal by the IN Hall effect device after the initial signal generated by the OUT Hall effect device.

Figure 9:
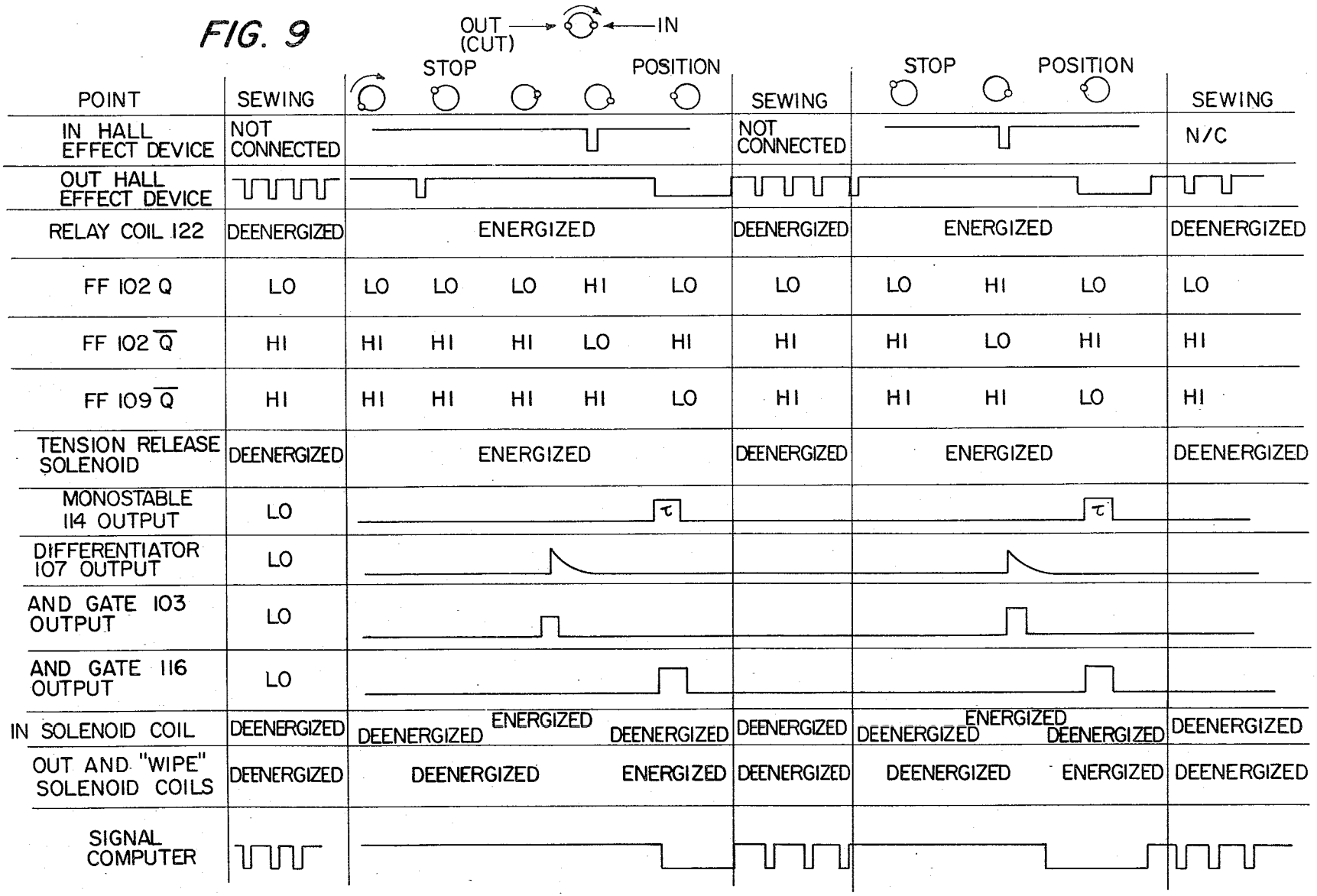
FIG. 9 is a hybrid flow chart of the sequence of electrical signals present in the circuitry of FIG. 8.

FIG. 9 is a hybrid flow chart of the sequence of electrical signals present in the various parts of the electronic circuitry illustrated in FIG. 8.

Across the top row of FIG. 9, the relative position of the magnet with respect to the IN and OUT Hall effect devices is schematically illustrated. The corresponding signals or states of various elements in FIG. 8 are either illustrated or stated below. That is, various signals are either illustrated as waveforms, their digital HIGH or LOW value indicated, or the energized or deenergized state of the various solenoids are stated.

Alternatively the apparatus can be operated manually by the use of the manual position of switch 123*a–b*, manual input switches 130 and 131 and manual reset switch 132, and by manually turning the hand wheel of the sewing machine.

As one skilled in the digital circuitry art can appreciate the electronic circuitry illustrated in FIG. 8 is by no means the only configuration suitable for operation with the present invention and accordingly, other embodiments may be utilized to provide signals for operating the various solenoids.

What is claimed is:

1. An automatic thread trimmer for use on a computerized embroidery sewing machine having a work table, a bobbin mechanism below said work table, an arm overhanging the work table with a needle driving means therein movable through one cycle for each cycle of operation of the sewing machine needle, and computerized control means connected to said machine for driving the needle driving means and shifting the needle according to the computer program, said thread trimmer comprising:

a thread catching member positioned below said work table and reciprocally movable across the path of a thread extending through said work table to the bobbin means for catching the thread at the end of the movement in one direction and drawing the thread with said thread catching member during movement in the other direction;

cutting means adjacent the path of movement of said thread catching means against which the thread catching means draws the thread for cutting the thread during movement in the other direction;

driving means connected to said thread catching member for driving said thread catching member in reciprocating movement;

wiper means positioned above said work table and having a wiper reciprocally movable across the path of the thread for removing the thread after it has been cut by said cutting means;

wiper actuating means connected to said wiper for driving said wiper in reciprocating movement;

signal producing means associatd with the needle driving means for producing first and second signals, the first when said needle driving means is at a position in the cycle of operation of the needle where the needle is raised clear of the path of reciprocation of said thread catching member, and the second when the needle is raised clear of the path of reciprocation of said wiper; and control means connected to said signal producing means and to said driving means and said wiper actuating means for receiving said signals from said signal producing means and discriminating when the signals are only in the order of said first signal and said second signal and thereupon actuating said driving means and said wiper actuating means in sequence.

2. An automatic thread trimmer as claimed in claim 1 in which said thread catching member comprises an arm having one end pivotally mounted and a pointed member on the other end, and having a notch between the arm and the portion of the pointed member adjacent the arm for engaging the thread therein.

3. An automatic thread trimmer as claimed in claim 1 in which said driving means and said wiper actuating means are solenoids, and said control means comprises means for providing actuating currents to said solenoids.

4. An automatic thread trimmer as claimed in claim 1 in which said signal producing means comprises means for producing said first signal when said needle driving means has risen just sufficiently to clear the path of reciprocation of said thread catching member, and said second signal just after the needle starts descending from its uppermost position.

5. An automatic thread trimmer as claimed in claim 1 in which said needle driving means has a shaft in said arm and said signal producing means are signal producing elements adjacent said shaft at approximately diametrically opposite positions relative to said shaft.

6. An automatic thread trimmer as claimed in claim 5 in which said signal producing elements are Hall effect devices.

7. An automatic thread trimmer as claimed in claim 1 in which said wiper comprises a wiper arm pivoted at one end and having the other end movable along the upper surface of the table, and said wiper actuating means is connected to said wiper arm for pivoting said wiper arm.

8. An automatic thread trimmer as claimed in claim 1 in which said control means comprises means for, when the signal which is first received from said signal producing means is a second signal, causing the control means to remain inactive and not actuate said wiper actuating means.

* * * * *